United States Patent [19]

Kapfer et al.

[11] Patent Number: 4,583,367

[45] Date of Patent: Apr. 22, 1986

[54] EXHAUST GAS TURBOCHARGER

[75] Inventors: Jürgen Kapfer, Renningen; Hans Körkemeier, Weissach; Klaus Gröger, Hemmingen, all of Fed. Rep. of Germany

[73] Assignee: Dr. Ing. h.c.F. Porsche Aktiengesellschaft, Weissach, Fed. Rep. of Germany

[21] Appl. No.: 670,937

[22] Filed: Nov. 13, 1984

[30] Foreign Application Priority Data

Nov. 12, 1983 [DE] Fed. Rep. of Germany ..... 3341119

[51] Int. Cl.[4] ..... F02B 37/00

[52] U.S. Cl. ..... 60/605; 180/312; 184/6.11

[58] Field of Search ..... 60/605; 184/6.11; 180/225, 296, 312; 55/187, DIG. 19

[56] References Cited

U.S. PATENT DOCUMENTS 2,639,779 5/1953 Glanzer ..... 55/187

3,978,671 9/1976 Gonzalez ..... 60/605 B

*Primary Examiner*—Douglas Hart

*Attorney, Agent, or Firm*—Barnes & Thornburg

[57] ABSTRACT

An exhaust gas turbocharger is provided for an internal-combustion engine which is mounted on a bracket connecting the internal-combustion engine to a motor vehicle body. The bracket includes a device therein for defoaming and degasifying the lubricating oil medium leaving the exhaust gas turbocharger.

12 Claims, 2 Drawing Figures

EXHAUST GAS TURBOCHARGER

BACKGROUND AND SUMMARY OF THE INVENTION

The present invention relates generally to internal-combustion engines and, more particularly, to exhaust gas turbo chargers for motor vehicles.

It is known to mount an exhaust gas turbo charger at the exhaust manifold of an internal-combustion engine. However, this arrangement not only limits the freedom of design and structural configurations in the area of the exhaust manifold, but also makes it more difficult to remove waste materials from the lubricating oil medium of the exhaust gas turbo charger by, for example, defoaming and degasifying.

It is, therefore, and object of the present invention to provide an exhaust gas turbo charger which may be mounted to an internal-combustion engine in such a way that the engine space is efficiently utilized.

Another object is to provide an exhaust gas turbo charger wherein lubricating oil medium leaving the exhaust gas turbo charger may be easily returned to its original condition.

These and other objects of the present invention are achieved in the provision of an exhaust gas turbo charger is provided for an internal-combustion engine which is mounted on a bracket connecting the internal-combustion engine to a motor vehicle body. The bracket includes a device therein for defoaming and degasifying the lubricating oil medium leaving the exhaust gas turbo charger. This turbo charger is supported on a knee-type extension of the bracket which includes a passageway therethrough to permit the lubricating oil medium to pass from the exhaust gas turbo charger into an interior chamber of the bracket. Passageways extend from this interior chamber to defoaming and degasifying devices to restore the lubricating oil medium to its original condition.

By this arrangement of the exhaust gas turbo charger according to the present invention, the available space within the engine space of a motor vehicle is more efficiently utilized. The function of the bracket supporting the internal-combustion engine is significantly expanded. This bracket maybe formed from a light-metal casting, and the chamber for receiving lubricating oil medium from the turbo charger may be integrally formed within the bracket without significant problems. The connections and passageways from the turbo charger through the knee-type extension and into the chamber to an oil return duct and a vent pipe are efficiently arranged so as to ensure a reliable waste removal performance and facilitate assembly in connection of the turbo charger to components of the internal-combustion engine, such as the oil pan and oil separator.

Further objects, features, and advantages of the present invention will become more apparent from the following description when taken with the accompanying drawings which show, for purposes of illustration only, an embodiment in accordance with the present invention.

DESCRIPTION OF THE PREFERRED EMBODIMENT

Figure 1:
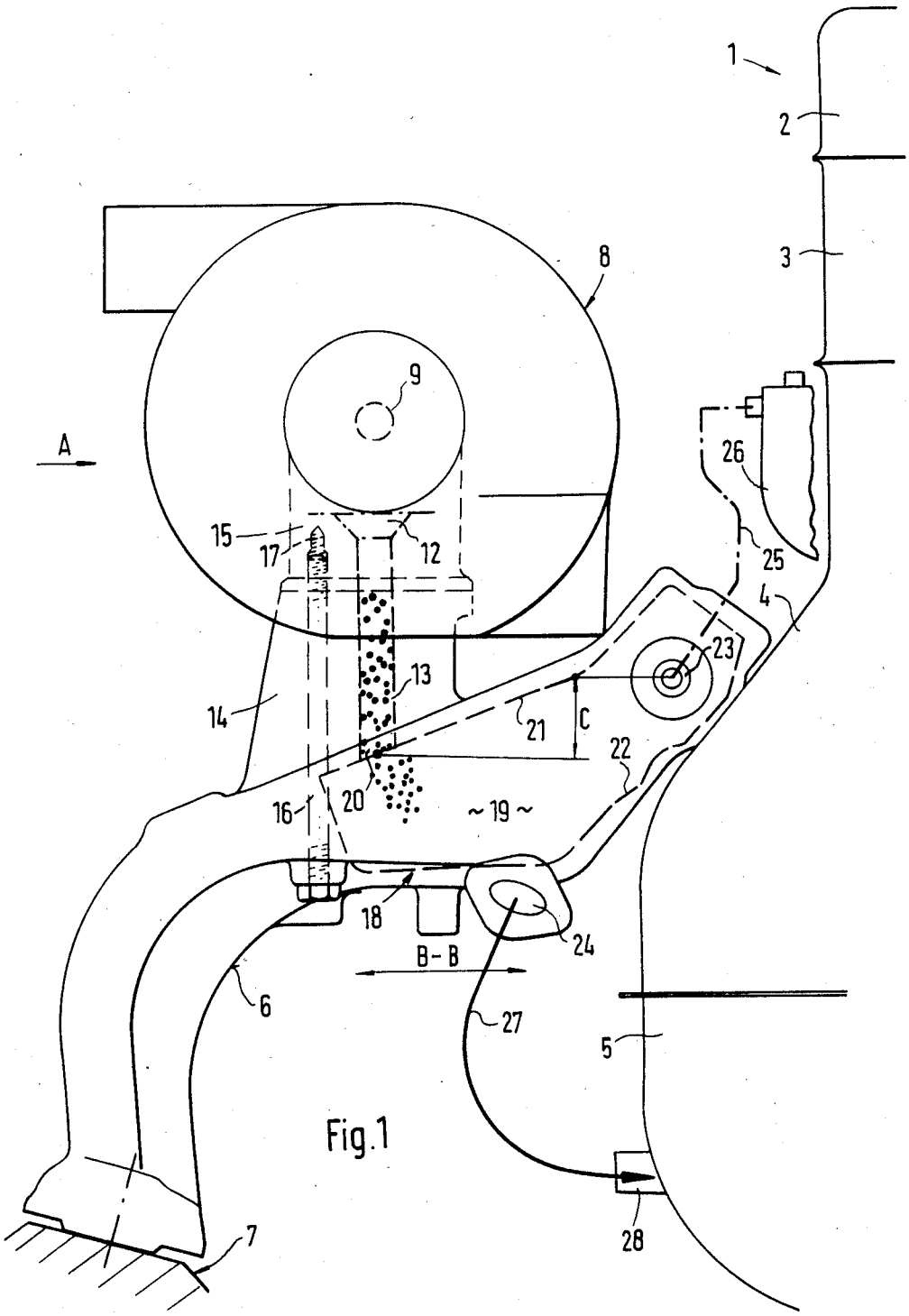
FIG. 1 shows a view in a longitudinal direction of an internal-combustion engine having an exhaust gas turbo charger mounted according to the principles of the present invention
Figure 2:
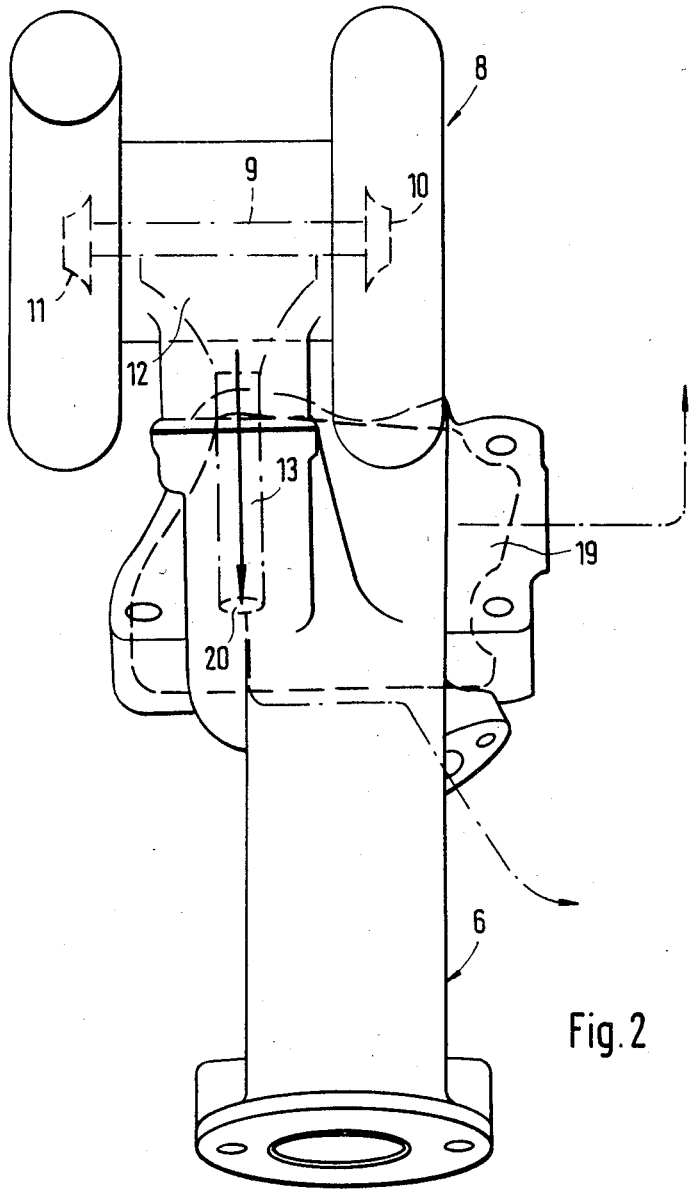
FIG. 2 is a view of the internal-combustion engine and exhaust gas turbo charger arrangement of FIG. 1 in the direction of Arrow A of FIG. 1.

FIG. 1, which illustrates a preferred embodiment of the present invention, shows valve cover 2, cylinder head 3, cylinder crankcase 4 and oil pan 5 of internal-combustion engine 1 in outline form. A bracket 6 is mounted on an elastic supporting element 7 and is connected with cylinder crankcase 4 by fastening elements that are not shown in detail in the drawings. Supporting element 7 is secured to the body of a motor vehicle (not shown in the drawings).

Bracket 6 is, for example, formed from a cast aluminum alloy and has a generally curved shape between supporting element 7 and its connection to internal-combustion engine 1 at cylinder crankcase 4. An exhaust gas turbo charger 8 is mounted to bracket 6. This turbo charger is driven by the exhaust gases of internal-combustion engine 1 and serves to move compressed air to its inlet side with respect to the internal combustion engine. Exhaust gas turbo charger 8 includes shaft 9 which carries turbine wheel 10 and compressor impeller 11 thereon. Lubricating oil medium is provided to lubricate shaft 9 during operation of the turbo charger. As this oil mixes with the gases and lubricates shaft 9, it enters duct 12 adjacent shaft 9 to be removed from the turbo charger.

Exhaust gas turbo charger 8 is mounted to a knee-type extension 14 of bracket 6. More specifically, turbo charger 8 is provided with a connection piece 15 which rests on extension 14. At least one screw 16 is provided for penetrating bracket 6 in an upward direction and threadably engaging connection piece 15 through extension 14 at threaded borehole 17 to secure turbo charger 8 to bracket 6. Sealing means are, for example, provided between extension 14 and connection piece 15.

Extension 14 includes a borehole 13 passing therethrough and connected with duct 12 when turbo charger 8 is secured to bracket 6 such that lubricating oil entering duct 12 passes downwardly through borehole 13. Bracket 6 includes a device 18 in which the lubricating oil medium exiting from turbo charger 8 is returned to is original condition by, for example, removing the waste material entrained in the lubricating oil (defoaming and degasifying). Device 18 includes a chamber 19 which is, for example, integrally formed within bracket 6. Chamber 19 is enclosed on all sides and is in fluid connection with borehole 13 such that the lubricating oil medium leaving exhaust gas turbo charger 8 flows through borehole 13 and enters chamber 19 through inlet opening 20.

The configuration and dimensions of chamber 19 are such that even when the internal-combustion engine or exhaust gas turbo charger 8 are at maximum operation, waste material is removed from the resulting quantity of lubricating oil medium entering chamber 19. This chamber is defined by diagonal walls 21 and 22 extending in a horizontal plain defined by the letters B B in FIG. 1. Further, chamber 19 is provided with connections 23 and 24. Connection 23 is located higher, by a distance C, than inlet opening 20 and leads to a venting pipe 25 which is connected with an outlet oil separator 26. In contrast, connection 24 is located lower than connection 23 and leads to an oil return duct 27 which is connected with oil pan 5 at 28.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An exhaust gas turbo charger for an internal-combustion engine of a motor vehicle, said engine being mounted at at least one bracket disposed at an elastic supporting element, wherein said bracket is used for holding of said exhaust gas turbo charger and includes therewith a device for the defoaming and degasification of lubricating oil medium leaving said exhaust gas turbo charger.

2. An exhaust gas turbo charger according to claim 1 wherein said device comprises a chamber integrated into said bracket and said bracket is formed from a light-metal casting.

3. An exhaust gas turbo charger according to claim 2 wherein said exhaust gas turbo charger is arranged at a knee-type extension of said bracket.

4. An exhaust gas turbo charger according to claim 3 wherein within said extension a borehole is provided via which said lubricating oil medium goes from said exhaust gas turbo charger into said chamber.

5. An exhaust gas turbo charger according to claim 2 wherein said chamber includes connections for an oil return duct and a venting pipe.

6. An exhaust gas turbo charger according to claim 5 wherein the connection for said venting pipe is located higher than the connection for said oil return duct.

7. An exhaust gas turbo charger according to claim 6 wherein an inlet opening of said borehole in said chamber is located away from said connection of the venting pipe and also lower (distance C) than last-mentioned connection.

8. An exhaust gas turbo charger arrangement, for connection to an internal-combustion engine secured to a motor vehicle body by bracket means, wherein said turbo charger is mounted on said bracket means and operably connected to said internal-combustion engine, said bracket means including therewith separating means for returning lubricating oil medium leaving said turbo charger to its original condition, said turbo charger including passageway means for permitting lubricating oil medium leaving said turbo charger to enter said separating means.

9. The turbo charger arrangement according to claim 8 wherein said separating means includes an oil receiving chamber integrally formed with said bracket means.

10. The turbo charger arrangement according to claim 8 wherein said separating means includes means for defoaming and degasifying said lubricating oil medium.

11. The turbo charger arrangement according to claim 10 wherein said separating means includes means for returning lubricating oil to the internal-combustion engine oil pan.

12. The turbo charger arrangement according to claim 10 wherein said separating means includes vertically separated fluid connections to an oil duct and a venting pipe.

* * * * *